US006722912B2

(12) United States Patent
Wu

(10) Patent No.: US 6,722,912 B2
(45) Date of Patent: Apr. 20, 2004

(54) ELECTRICAL CONNECTOR HAVING A LATCH MECHANISM

(75) Inventor: Jerry Wu, Irvine, CA (US)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 10/210,129

(22) Filed: Jul. 31, 2002

(65) Prior Publication Data

US 2004/0023544 A1 Feb. 5, 2004

(51) Int. Cl.[7] ..... H01R 13/627
(52) U.S. Cl. ..... 439/352; 439/357
(58) Field of Search ..... 439/352, 357, 439/350, 351, 353, 354, 355, 358, 3

(56) References Cited

U.S. PATENT DOCUMENTS 5,564,939 A * 10/1996 Maitani et al. ..... 439/352
6,371,787 B1 * 4/2002 Branch et al. ..... 439/352

* cited by examiner

*Primary Examiner*—Alexander Gilman
(74) *Attorney, Agent, or Firm*—Wei Te Chung

(57) ABSTRACT

An electrical connector (1) includes a base (10) and a cover (20) assembled together. The base and cover each define a pair of channels (121, 221) on opposite sides thereof and a pair of depressions (19, 29) on rear portion (14) thereof. A pull tab (80) has an operation portion (81) and a pair of arms (82) extending from the operation portion. A pair of resilient portions (85) is formed on inner sides of the arms. The pair of arms are received in the channels with the operation portion remaining outside of the cover and the base. The resilient portions are received in the depressions. Each arm mechanically contacts with a latch spring (70) latching with a complementary connector. When the pull tab is pulled, the latch spring separates with the complementary connector, the resilient portions bent to a deflective shape. When the pull is released, the resilient portions resume to an original shape to motivate the pull tab returning back.

18 Claims, 9 Drawing Sheets

ELECTRICAL CONNECTOR HAVING A LATCH MECHANISM

CROSS-REFERENCE TO RELATED APPLICATIONS

The present invention is a related application of the copending patent application entitled, "ELECTRICAL CONNECTOR HAVING A LATCH MECHANISM" by Jerry Wu, filed on Jul. 30, 2002 with an unknown serial number and assigned to the assignee of the present invention, and the content of which is incorporated herein by reference now.

BACKGROUND OF THE INVENTION

1. Field of the Invention

The present invention relates to an electrical connector, and particularly to an electrical connector having a pull tab and latch springs for engaging and releasing a mated complementary connector.

2. Description of Prior Art

Referring to U.S. Pat. No. 5,564,939, a conventional electrical connector disclosed in the patent has a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 and the latch springs 22, 22A are positioned outside of the housing 21, they are very easy to be damaged when a force is exerted thereon. When two or more such connectors are arranged side by side, a relatively large space is needed between every two connectors and this adversely affects the compact design of an electronic system including such connectors. Furthermore, when the operating member 23 is released, the latch springs 22, 22A exert a force to push the operating member 23 to its original position. However, the force is too little to pull the operating member 23 exactly to the original position. To overcome the above mentioned disadvantages, an electrical connector is needed that a pull tab of the connector can be automatically return to the original position, and a better protection is provided to the latch springs to prevent them from damage by an external force.

SUMMARY OF THE INVENTION

It is an objective of the present invention to provide an electrical connector having a pull tab engaging with a pair of latch springs for latching and releasing a mated complementary connector, the pull tab with the latch springs can automatically resume to an original position after releasing the complementary connector.

In order to achieve the object above-mentioned, an electrical connector in accordance with the present invention comprises a base, an insulating housing, a cover assembled to the cover, a pull tab and a pair of latch springs. The base defines a pair of elongated first channels on opposite sides thereof. A mating frame is formed on a front end thereof. A pair of depressions are defined in a rear portion of the base which is opposite to the front end. The depressions are in communication with the first channel. The insulting housing is assembled into the mating frame and has a plurality of terminals received in the insulating housing. The cover defines a pair of elongated second channels on opposite sides thereof corresponding to the first channels of the base. The pull tab has an operation portion and a pair of arms extending from a pair of ends of the operation portion. The pair of arms are respectively received in the first and second channels and the operation portion located outside the base and the cover. Each arm has a latch releasing portion at a free end thereof and a resilient portion protruding inwardly from the arm, the resilient portions are received in the depressions defined in the base. The latch springs cooperate with the latch releasing portions for latching with the complementary connector when said complementary connector mates with the electrical connector. When the pull tab is pulled rearwards, the latch releasing portions push the latch springs to separate the complementary connector. The resilient portions of the pull tab are bent to a deflective shape. When the pull tab is released, the resilient portion resume to an original shape to motivate the pull tab return back to an original position.

Other objects, advantages and novel features of the invention will become more apparent from the following detailed description when taken in conjunction with the accompanying drawings.

DETAILED DESCRIPTION OF THE INVENTION

Figure 1:
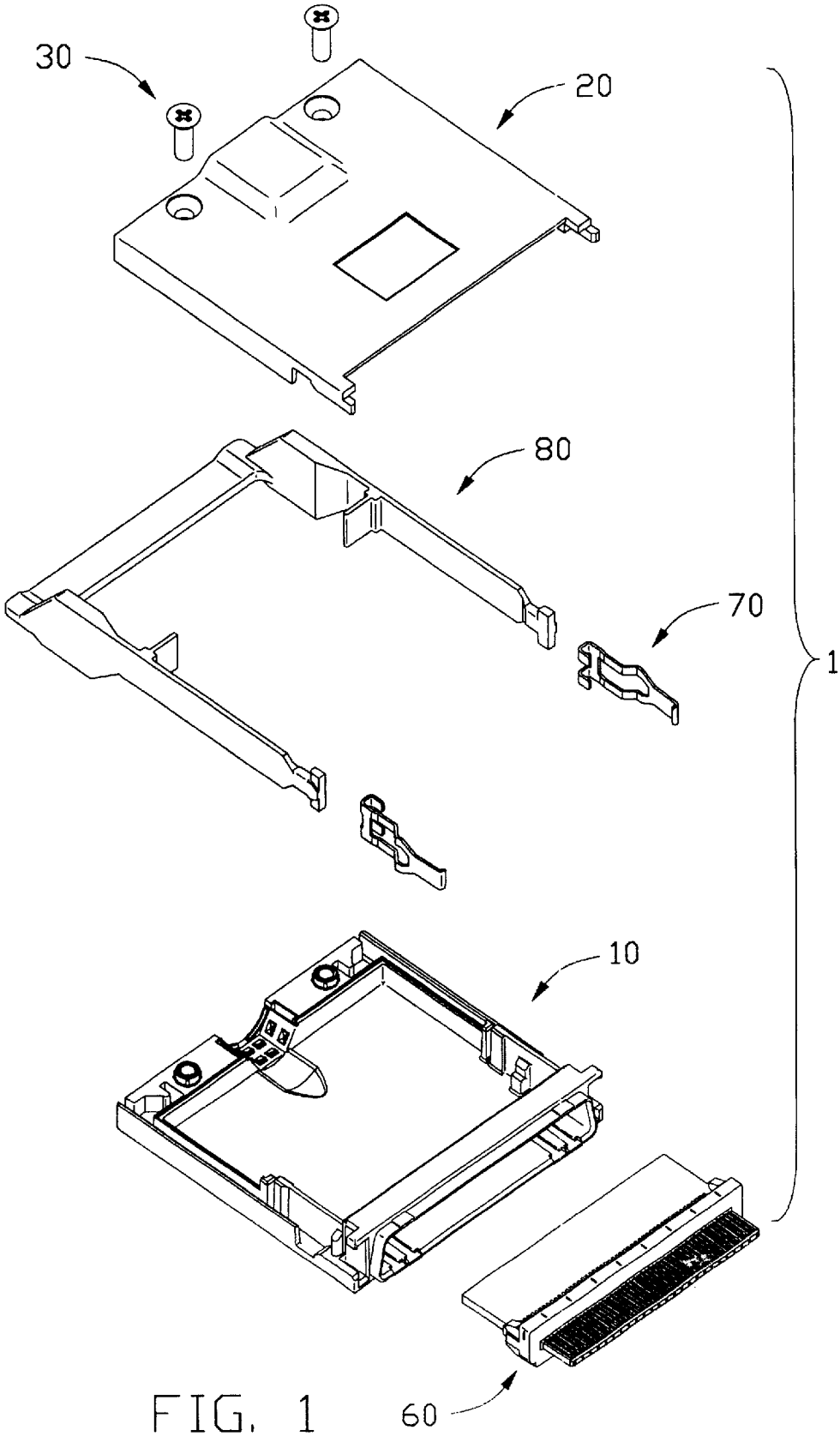
FIG. 1 is an exploded perspective view of an electrical connector in accordance with the present invention.

Referring to FIG. 1, an electrical connector 1 in accordance with the present invention comprises a base 10, a cover 20 for being assembled to the base 10, a pair of screws 30 for securing the cover 20 on the base 10, a connector subassembly 60, a pair of latch springs 70, and a pull tab 80.

Figure 2:
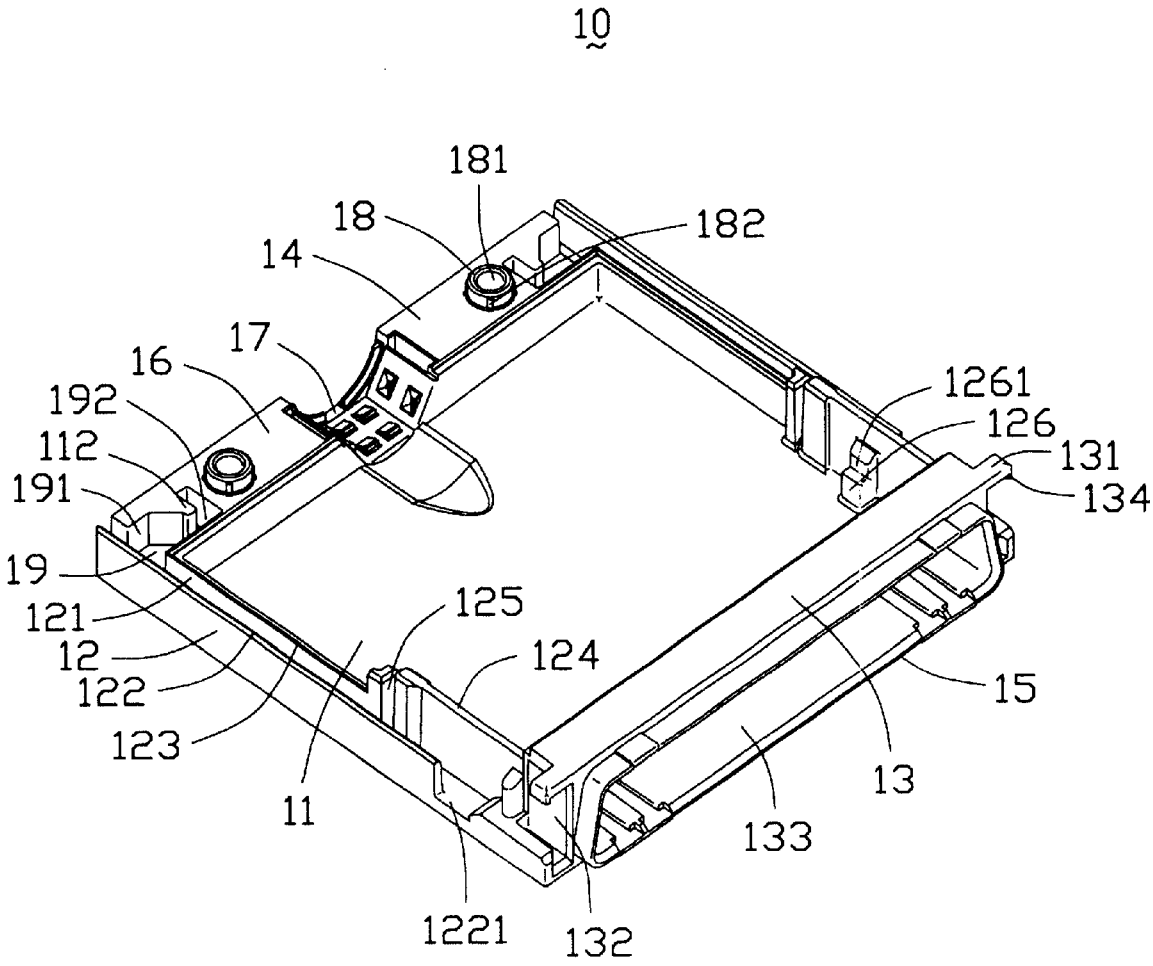
FIG. 2 is an enlarged perspective view of a base shown in FIG. 1.
Figure 8:
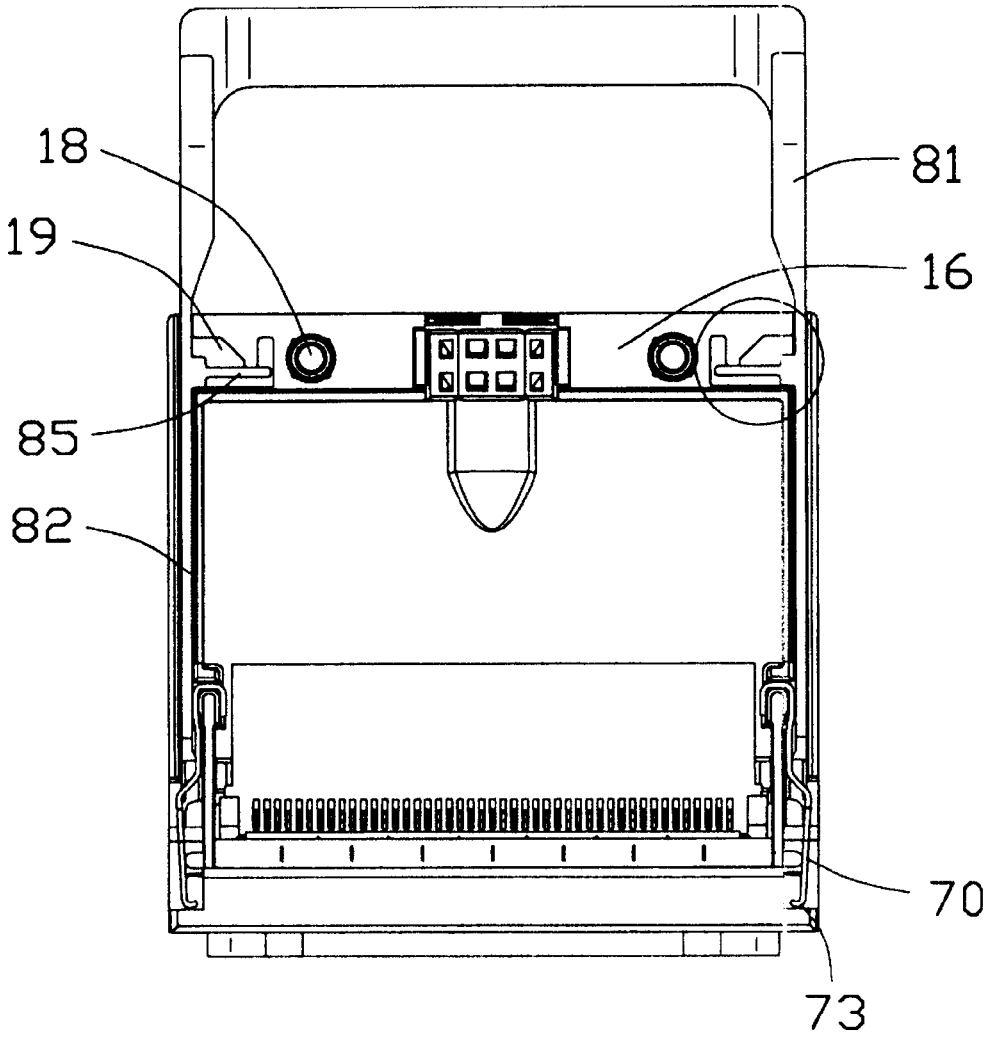
FIG. 8 is a top view of FIG. 7, in which the latch springs are in a latching position.
Figure 9:
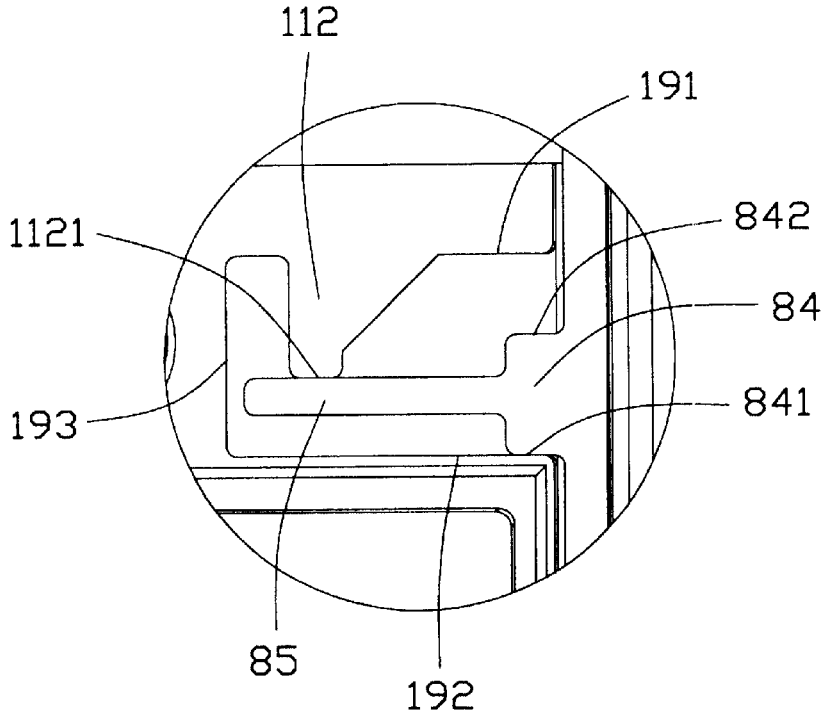
FIG. 9 is a partially enlarged view of FIG. 8 showing a resilient portion in an original shape.
Figure 10:
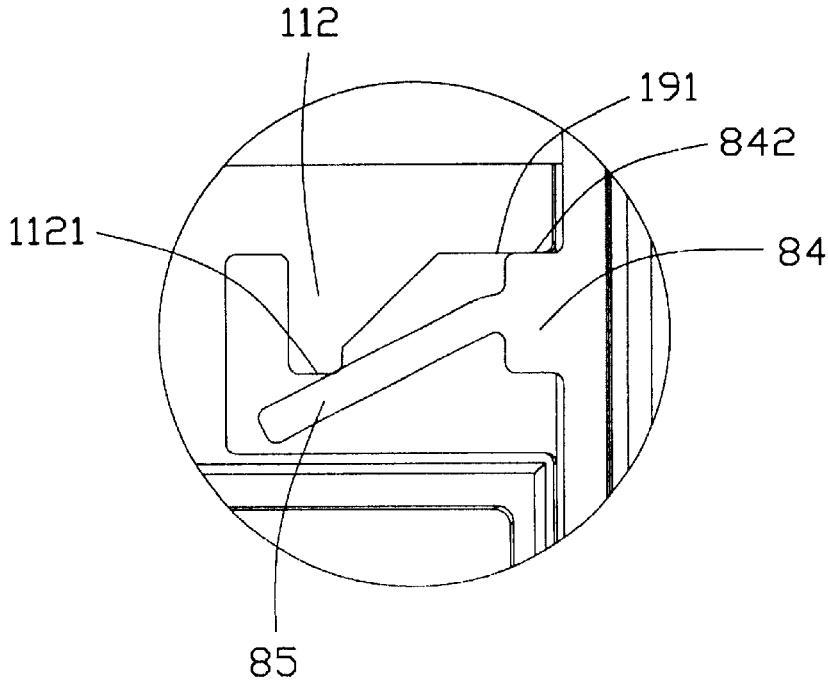
FIG. 10 is a view similar to FIG. 9, showing the resilient portion in a deflective shape.

The base 10 and the cover 20 are formed by die casting metallic material, for example, aluminum alloy. Referring to FIG. 2, the base 10 comprises a base plate 11 and a pair of sidewalls 12 upwardly extending from opposite lateral sides of the base plate 11. Each sidewall 12 defines an elongated channel 121 from a rear portion 14 toward a front end 15 of the base 10 and extending through a top engaging face 16 thereof. Each sidewall 12 is divided into an outer wall 122 and an inner wall 123 by the channel 121. The inner walls 123 each have a higher shoulder portion 124 adjacent to the front end 15. The shoulder portions 124 each define a vertical slit 125 at a rear end thereof. The outer walls 122 each define a cutout 1221 adjacent to the front end 15. A pair of blocks 126 is formed on inner sides of the shoulder portions 124. Each block 126 defines a step portion 1261. A mating frame 13 is formed at the front end 15 of the base 10. The mating frame 13 defines an opening 133 through the front end 15. A pair of engaging ears 131 is formed on opposite sides of a top of the mating frame 13 and extends laterally. Each engaging ear 131 has a protrusion 134 downwardly extending from a free end thereof. A pair of engaging spaces 132 is defined in opposite sides of the mating frame 13 and between the engaging ears 131 and the base plate 11. The base 10 has a first substantially semicircular opening 17 at the rear portion 14. A pair of posts 18 protrudes upwardly from the engaging face 16, located respectively at on opposite sides of the first opening 17. Each post 18 defines a screw hole 181 therein and has four ribs 182 on a circumferential periphery thereof. Further referring to FIGS. 8 and 9, a pair of depressions 19 is defined in the rear portion 14 of the base 10 from the engaging face 16. The pair of depressions 19 locate on opposite ends of the rear portion 14 and are in communication with the channels 121. Each depression 19 has a front stop surface 192 at a front side thereof, a rear stop surface 191 at a rear side thereof, and an inner surface 193 at a side opposite to the channel 121. A supporting block 112 protrudes the rear stop surface 191 toward the rear front surface 192 and adjacent to the inner surface 193.

Figure 3:
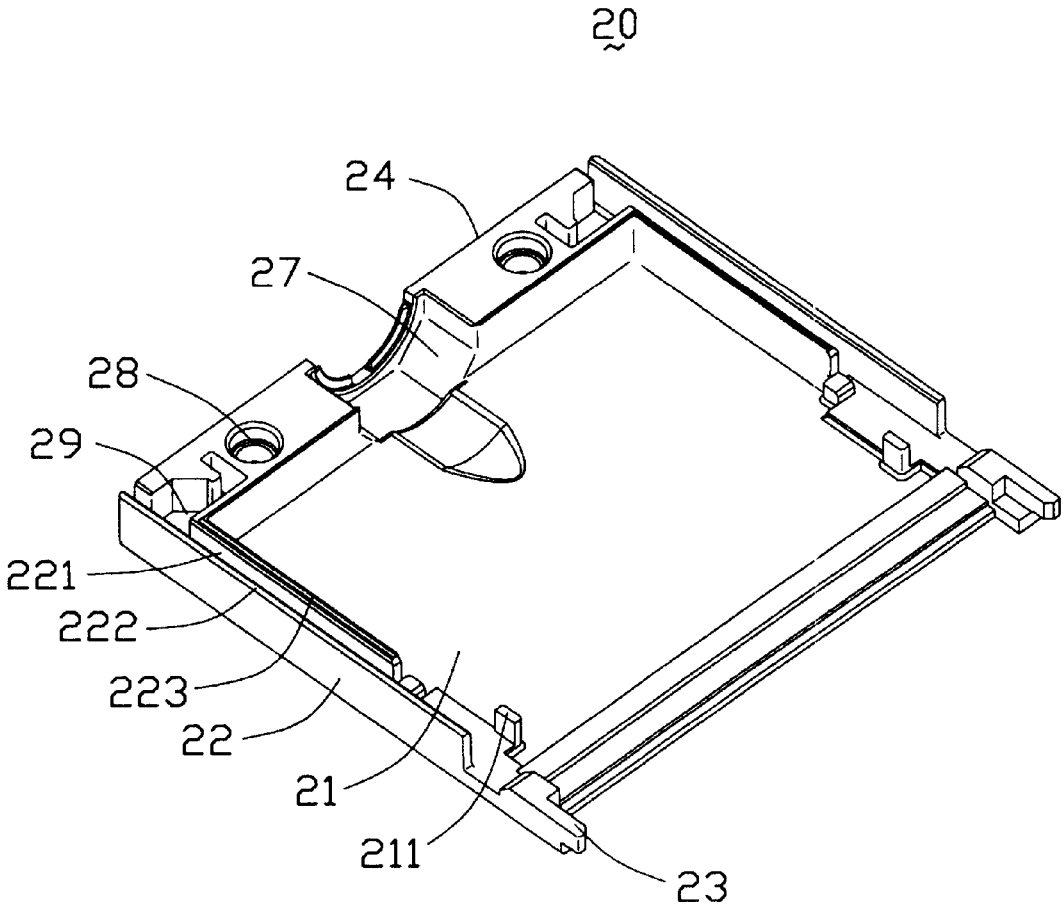
FIG. 3 is an enlarged perspective view of a cover shown in FIG. 1 from a bottom aspect.

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to the channel 121 of the base 10. Each sidewall 22 is divided into an outer wall 222 and an inner wall 223 by the channel 221. A pair of blocks 211 extends downwardly from the cover plate 21 corresponding to the blocks 126. A pair of projections 23 extends forwardly from opposite sides of a front end of the cover plate 21. A semicircular second opening 27 is defined in a rear end 24 of the cover plate 21 corresponding to the first opening 17 of the base 10. A pair of holes 28 is defined in opposite sides of the second opening 27. Each hole 28 has a diameter generally equal to an outer diameter of each of the posts 18. A pair of depressions 29 is also defined on opposite side of the holes 28. The depressions 29 have identical structures with the depressions 19 and will not be described here.

Figure 4:
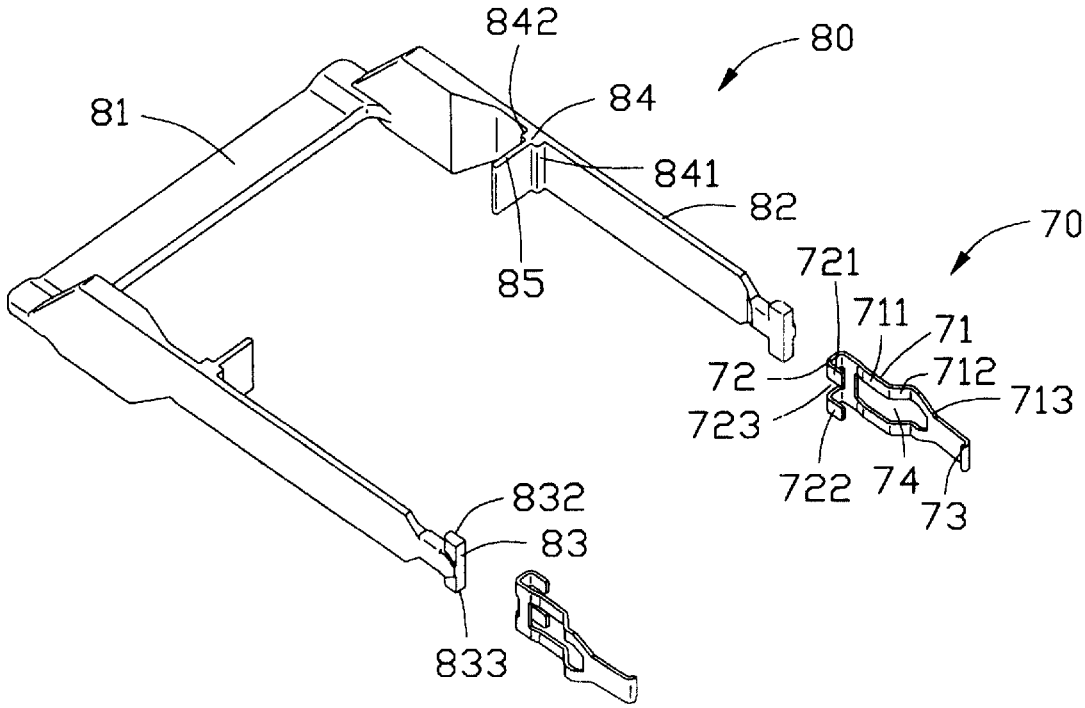
FIG. 4 is an enlarged perspective view of a latch spring and a pull tab shown in FIG. 1.

Referring to FIG. 4, each of the latch springs 70 is formed by stamping a metal sheet and has a body portion 71, a U-shaped claw portion 72 formed at a rear end of the body portion 71, and an L-shaped claw portion 73 formed at a front end of the body portion 71. The U-shaped claw portion 72 has an upper and a lower claw portions 721, 722, and a gap 723 defined between the upper and lower claw portions 721, 722. An elongated cutout 74 is defined in the body portion 71 in a front-to-rear direction. The body portion 71 comprises a rear portion 711, a sloping portion 712 inclined outwardly from the rear portion 711, and a front portion 713 extending inwardly from the sloping portion 712.

The pull tab 80 comprises an operation portion 81, a pair of arms 82 extending forwardly from opposite sides of the operation portion 81, and a pair of latch releasing portion 83 formed at front ends of the arms 82, respectively. Each latch releasing portion 83 has upper and lower ends 832, 833. Each arm 82 has a stopper 84 formed on inner side thereof and adjacent to the operation portion 81. A pair of spring plates 85 is protruded from inner sides of the stoppers 84. The stopper 84 has a front surface 841 and rear surface 842.

Figure 5:
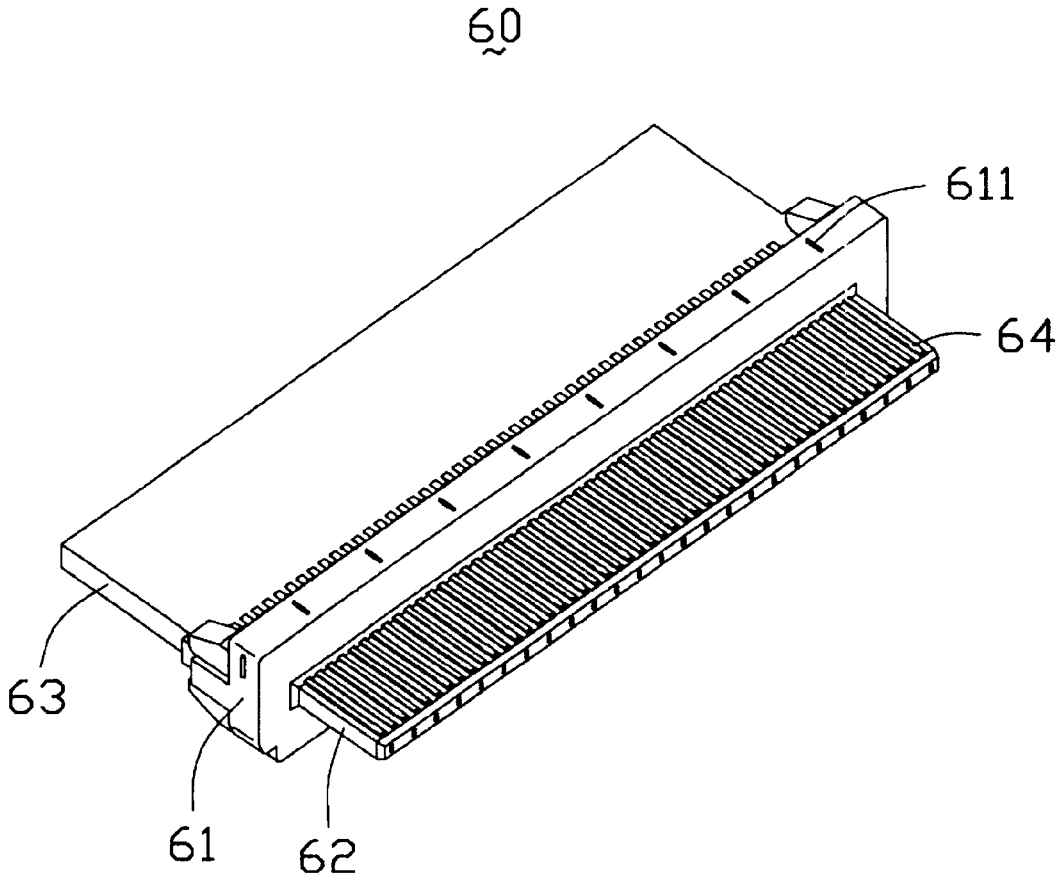
FIG. 5 is an enlarged perspective view of a connector subassembly shown in FIG. 1.
Figure 6:
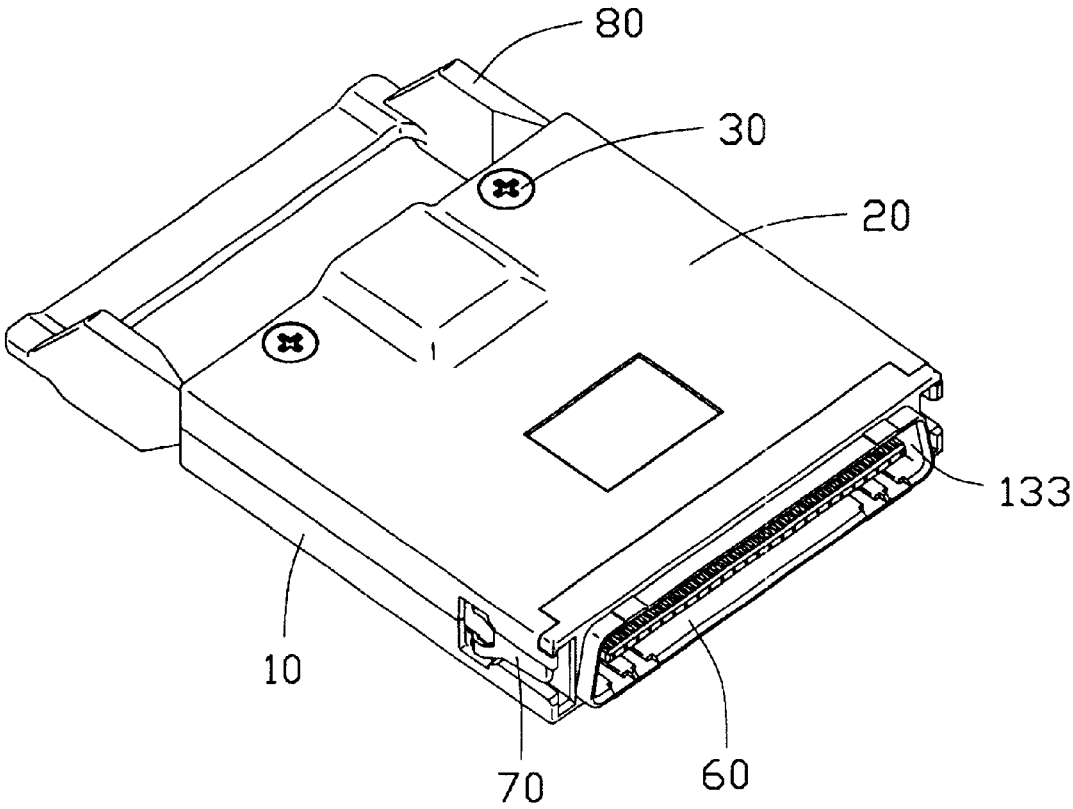
FIG. 6 is an assembled view of the electrical connector shown in FIG. 1.
Figure 7:
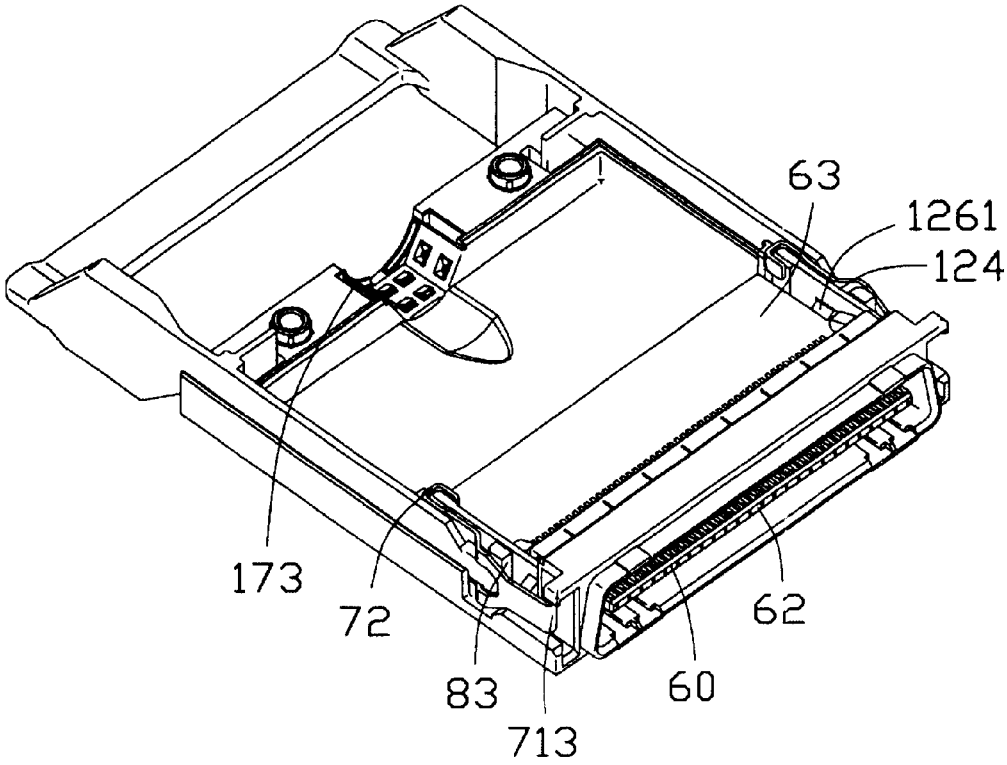
FIG. 7 is a view similar to FIG. 6, with the cover being unmoved.

Referring to FIG. 5, the connector subassembly 60 comprises an insulating housing 61, a tongue portion 62 extending forwardly from the housing 61, a printed circuit board (PCB) 63 assembled to the housing 61 at a rear side thereof. A plurality of contacts 64 is received in the tongue portion 62 and extends through the housing 61 to electrically connect the PCB 63. The housing 61 has a plurality of ribs 611 formed on a top surface and opposite side surfaces thereof.

Referring to FIGS. 6–9, in assembly, the connector subassembly 60 is assembled to the base 10 with the tongue portion 62 received into the opening 133 and the ribs 611 on opposite side surfaces engaged with inner surfaces of the shoulder portions 124 of the inner walls 123. The PCB 63 is received in the base 10 between the two sidewalls 12 and upon the step portions 1261 of the blocks 126. Two latch springs 70 are respectively assembled to the pull tab 80 by the latch releasing portions 83 engaging with inner faces of the latch springs 70, respectively. The latch releasing portions 83 are positioned at inner faces of the front portions 713. Then, the latch springs 70 together with the pull tab 80 are assembled to the base 10. The arms 82 are placed into the channels 121 with the operation portion 81 remaining outside of the rear portion 14 of the base 10. The stoppers 84 and the spring plates 85 are fitted into the depressions 19. The front surfaces 841 of the stoppers 84 abut against the front stop surfaces 192 of the depressions 19. The spring plates 85 are received in gaps between tip ends 1121 of the supporting blocks 112 and contact with the tip ends 1121. The U-shaped claw portions 72 are received into the slits 125 and engaged with the shoulder portions 124 to secure the latch springs 70 to the base 10. The L-shaped claw portions 73 extend into the engaging spaces 132. The cover 20 is assembled to the base 10 by placing the projections 23 beneath the pair of engaging ears 131. Then a rear portion of the cover 20 is rotated downwardly about the pair of engaging ears 131 until a bottom face of the cover 20 intimately abuts the top engaging face 16 of the base 10. Upper portions of the arms 82 are received in the channels 221 and upper portions of the stopper 84 and spring plates 85 are received into the depressions 29. The blocks 211 abut a top face of the PCB 63 above the step portions 1261 of the blocks 126. The posts 18 are received into the holes 28 with the four ribs 182 engaging with inner surfaces of the holes 28. The first and second openings 17 and 27 together form a cable receiving opening for extension of the cable. Finally, the screws 30 are screwed into the screw holes 181 to securely fasten the cover 20 and the base 10 together, whereby the electrical connector 1 in accordance with the present invention is obtained.

An operation of the electrical connector 1 in introduced below.

Referring to FIGS. 7–10, when a complementary connector (not shown) is mated with the electrical connector 1 of the present invention, the L-shaped claw portions 73 clamp corresponding engaging portions of the complementary connector. The electrical connector 1 is unmated with the complementary connector by the following operation. An operator grips the operation portion 81 of the pull tab 80 and pull it rearward, whereby the pull tab 80 moves rearward. The upper and lower ends 832, 833 slide in the base 10 and the cover 20. In the same time, the spring plates 85 are elastically deformed and transmit a pull force to the supporting block 112. Then, the whole connector moves together with the pull tab 80. When the latch releasing portions 83 come into contact with the slope portions 712, they exert an outward force on inner faces of the slope portions 712. The latch spring 70 is elastically deformed and the front portion 713 is pushed out. Thus, the L-shaped claw portions 73 are driven to move out of the engaging portions of the complementary connector. Accordingly, the latch springs 70 no longer latch with the complementary connector, and the electrical connector 1 in accordance with the present invention can be readily separated from the complementary connector as mentioned below.

When the rear surfaces 842 of the stoppers 84 abut against the rear surface 191 of the depression 19, the force pulling the pull tab 80 is transferred into a force pulling the electrical connector 1. The spring plate 85 is bent to a deflective shape. Hence, the electrical connector 1 is pulled out from the complementary connector by the pull tab 80. When the pulling force acting on the pull tab 80 is released, the spring plates 85 resume to the original shape and the stoppers 84 slide back to abut against the front surfaces 192. The latch spring 70 resumes to its original position by a spring force of itself.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

a base defining a pair of elongated first channels on opposite sides thereof, a mating frame formed on a front end thereof, a pair of depressions defined in a rear portion of the base which is opposite to the front end, each depression communicating with a corresponding first channel;

an insulting housing assembled into the mating frame and having a plurality of terminals received in the insulating housing;

a cover assembled to the base, defining a pair of elongated second channels on opposite sides thereof corresponding to the first channels of the base;

a pull tab having an operation portion and a pair of arms extending from a pair of ends of the operation portion, the pair of arms respectively received in the first and second channels and the operation portion located outside the base and the cover, each arm having a latch releasing portion at a free end thereof and a resilient portion protruding inwardly from the arm, the resilient portions being received in the depressions defined in the base; and a pair of latch springs cooperating with the latch releasing portions for latching with the complementary connector when said complementary connector mates with the electrical connector, when the pull tab is pulled rearwards, the latch releasing portions pulling the latch springs for separating from the complementary connector, the resilient portions of the pull tab bent to a deflective shape, when the pull tab is released, the resilient portions resume to an original shape to motivate the pull tab to return back to original position.

2. The electrical connector as described in claim 1, wherein each latch spring having a first claw portion engaging with the base, a second claw portion and a sloping portion between the first and second claw portions, and engaging with the latch releasing portion of the pull tab.

3. The electrical connector as described in claim 1, wherein the mating frame has a pair of engaging ears extending laterally on opposite sides of a top thereof, a pair of projections extends forwardly from opposite sides of the cover, the projections are placed beneath the pair of engaging ears to prevent the cover from being moved upwardly.

4. The electrical connector as described in claim 1, wherein the base and the covet are made of metallic material.

5. The electrical connector as described in claim 1, wherein the base has a pair of screw holes, a pair of screws extends through the cove and threadedly engage with the screw holes to thereby fasten the cover and the base together.

6. The electrical connector as described in claim 1, wherein each resilient portion comprises a stopper projecting from an inner side of the arm and a spring plate extending from the stopper.

7. The electrical connector as described in claim 6, wherein the cover defines a pair of depressions corresponding to the depressions of the base, the depressions of the cover and the base together receive the stoppers and the spring plates of the pull tab.

8. The electrical connector as described in claim 6, wherein the depressions of the base each have a front stop surface at a front side thereof, a rear stop surface at a rear side thereof.

9. The electrical connector as described in claim 8, wherein each spring plate positions between the front stop surface and the rear stop surface.

10. The electrical connector as described in claim 9, wherein a supporting block protruding from the rear stop surface and toward the front stop surface, the spring plate positions between the supporting block and the front stop surface of the depression.

11. The electrical connector as described in claim 10, wherein the spring plate is in the original shape when the stopper abuts against the front stop surface of the depression.

12. The electrical connector as described in claim 11, wherein when the stopper abuts against the rear stop surface of the depression, the spring plate is pushed by the supporting block to bent to the deflective shape.

13. The electrical connector as described in claim 12, wherein each latch spring defines a cutout in the sloping portion, the arm of the pull tab runs through the cutout from an outside face to an inside face of the sloping portion, so that the latch releasing portions abut against inner faces of the sloping portions of the latch springs.

14. The electrical connector as described in claim 13, wherein the base has a pair of sidewalls upwardly extending therefrom, the first channels are defined in the sidewalls.

15. An electrical connector comprising:

a base/cover assembly defining a space, a pair of channels defined in opposite sides of the base/cover assembly;

an insulating housing disposed in a front portion of the space;

a pull tab having a pair of arms received in the pair of channels of the base/cover assembly, said pull tab being slidable relative to the base/cover assembly in a front-to-back direction, each arm having a latch releasing portion at a free end thereof;

a pair of latch springs cooperating with the latch releasing portions of the pull tab and being deflectable in a lateral direction perpendicular to said front-to-back direction when the pull tab moves backwardly;

wherein recoverable engagement is formed between the pull tab and at least one of the base/cover assembly and the housing when said pull tab is moved backwardly, so that the pull tab is automatically resumed back to an original position due to said recoverable engagement when a rearward force imposed on the pull tab is released.

16. The connector as described in claim 15, wherein said latch spring is outwardly deflected when said pull tab moves backwardly.

17. The connector as described in claim 15, wherein said pull tab includes a spring plate essentially constantly engaged with a portion of the base/cover assembly.

18. The connector as described in claim 15, wherein said at least one of the base/cover assembly and the housing is the base/cover assembly.

* * * * *